United States Patent [19]

Hillstrom et al.

[11] Patent Number: 4,782,610

[45] Date of Patent: Nov. 8, 1988

[54] DISPLAY ASSEMBLY WITH ILLUMINATION SYSTEM

[75] Inventors: David U. Hillstrom, Novi; Donald R. Gaines, Farmington Hills; Donald L. Gaines, Northville; John E. Chandler, Plymouth, all of Mich.

[73] Assignee: Marketing Displays, Inc., Farmington Hills, Mich.

[21] Appl. No.: 905,867

[22] Filed: Sep. 10, 1986

[51] Int. Cl.[4] ..... G09F 13/00

[52] U.S. Cl. ..... 40/152.2; 40/156; 40/537

[58] Field of Search ..... 40/152.2, 156, 152, 40/13, 577

[56] References Cited

U.S. PATENT DOCUMENTS

| | | | |
|---|---|---|---|
| 626,256 | 6/1899 | Webb . | |
| 1,013,410 | 1/1912 | Lynch . | |
| 1,067,024 | 7/1913 | Hall et al. | 40/550 |
| 1,190,600 | 7/1916 | Shreves et al. | 40/152.2 |
| 1,192,982 | 8/1916 | Bristol | 40/552 |
| 1,267,021 | 5/1918 | Watts . | |
| 1,437,635 | 3/1924 | Watts . | |
| 1,484,231 | 2/1924 | Pistocco . | |
| 1,532,865 | 4/1925 | Beck . | |
| 1,541,200 | 6/1925 | Thomson . | |
| 1,613,933 | 1/1927 | Castleton . | |
| 1,726,817 | 9/1929 | Franklin . | |
| 1,750,118 | 3/1930 | Mueller, Jr., et al. . | |

(List continued on next page.)

FOREIGN PATENT DOCUMENTS

| | | |
|---|---|---|
| 241196 | 10/1962 | Australia . |
| 529802 | 7/1954 | Belgium . |
| 660595 | 3/1965 | Belgium . |
| 835010 | 2/1970 | Canada . |
| 97389 | 11/1963 | Denmark . |
| 0114453 | 8/1984 | European Pat. Off. . |
| 1181967 | 6/1959 | France . |
| 97398A | 10/1960 | Netherlands . |
| 328624 | 4/1958 | Switzerland . |
| 282866 | 12/1927 | United Kingdom . |
| 339325 | 12/1930 | United Kingdom . |
| 479913 | 7/1938 | United Kingdom . |
| 519632 | 4/1940 | United Kingdom . |
| 893632 | 4/1962 | United Kingdom . |
| 1056999 | 2/1967 | United Kingdom . |
| 1295378 | 11/1972 | United Kingdom . |
| 1404624 | 9/1975 | United Kingdom . |
| 2005535 | 4/1979 | United Kingdom . |
| 2142459A | 1/1985 | United Kingdom . |

OTHER PUBLICATIONS

NEWS - The Society of the Plastics Industry, Inc., New York-7/21/83 (3 pages).

*Primary Examiner*—Gene Mancene
*Assistant Examiner*—Wenceslao J. Contreras
*Attorney, Agent, or Firm*—Harness, Dickey & Pierce

[57] ABSTRACT

The present invention provides an assembly for displaying a sign, including a sign frame and one or more lights disposed on the frame, with each light including one or more electrical conductors for conducting electric current thereto from an electric power source. The display assembly includes an electrical conductor associated with the frame and connectable to the electric power source, a light socket interconnectable with the frame and having a socket opening for receiving the light inserted therein, a connector interconnectable with the light socket and having at least one electrical conductor disposed for electrical contact with the electrical conductor on the light when the light is inserted into the light socket and the light socket is interconnected with the conductor. The electrical conductor on the connector is interconnectable in electrical contact with the electrical conductor on the frame in order to establish electrical communication between the light and the electric power source. Preferably, the assembly also includes electric or electronic controls for causing continuous, blinking, sequential, or other illumination patterns for multiple lights positioned about the frame of the display assembly.

24 Claims, 6 Drawing Sheets

U.S. PATENT DOCUMENTS

| | | | |
|---|---|---|---|
| 1,856,349 | 5/1932 | Bigelow . | |
| 1,882,454 | 10/1932 | Spalding . | |
| 2,030,379 | 2/1936 | Lippold . | |
| 2,144,038 | 1/1939 | Trump . | |
| 2,164,680 | 7/1939 | Donovan . | |
| 2,165,704 | 7/1939 | Hood . | |
| 2,243,912 | 6/1941 | Legler . | |
| 2,292,785 | 8/1942 | Henne . | |
| 2,603,017 | 7/1952 | Merrill . | |
| 2,882,633 | 4/1959 | Howell . | |
| 2,949,324 | 8/1960 | Birge et al. . | |
| 2,979,842 | 4/1961 | Ridder . | |
| 3,070,914 | 1/1963 | Henderson et al. . | |
| 3,205,601 | 9/1965 | Gawne et al. . | |
| 3,310,901 | 3/1967 | Sarkisian . | |
| 3,360,893 | 1/1968 | Wattelez . | |
| 3,386,198 | 6/1968 | Howell . | |
| 3,440,749 | 4/1969 | Parson et al. | 40/552 |
| 3,447,253 | 6/1969 | Coad | 40/552 |
| 3,662,482 | 5/1972 | Sarkisian . | |
| 3,720,979 | 3/1973 | Krawagna . | |
| 3,885,335 | 5/1975 | Egermayer . | |
| 4,038,770 | 8/1977 | Bott . | |
| 4,094,083 | 6/1978 | Fund . | |
| 4,096,656 | 6/1978 | Diceglie | 40/152.2 |
| 4,145,828 | 3/1979 | Hillstrom . | |
| 4,235,030 | 11/1980 | Astolfi . | |
| 4,237,632 | 12/1980 | Segerstad . | |
| 4,358,917 | 11/1982 | Oda et al. . | |
| 4,364,192 | 12/1982 | Lloyd . | |
| 4,512,094 | 4/1985 | Seely . | |
| 4,512,095 | 4/1985 | Seely . | |
| 4,523,400 | 6/1985 | Seely . | |
| 4,580,361 | 4/1986 | Hillstrom et al. . | |

DISPLAY ASSEMBLY WITH ILLUMINATION SYSTEM

BACKGROUND AND SUMMARY OF THE INVENTION

The present invention relates generally to an assembly for displaying a sign, wherein the display assembly includes a sign frame and one or more lights disposed on the frame. The present invention is particularly well suited for application in poster frame and display holder devices for various types of replaceable posters, advertising materials, and the like.

Various frame and display devices have been provided for holding and displaying posters, signs, or advertising materials. Some particularly advantageous examples of such devices are illustrated and described in U.S. Pat. Nos. 3,310,901 and 4,145,828. Frequently it has been found desirable to provide such previous display devices with lights (illuminated sequentially or otherwise) disposed on a frame or periphery of the display assembly for purposes of drawing a viewer's attention to the display and for highlighting the message on the sign or advertising material.

Many of the above-mentioned illumination systems used in conjunction with such display devices, however, are relatively expensive to manufacture and assemble, and have been found to interfere with the ease and convenience of replacing the poster, sign or other displayed message. Accordingly, the present invention provides a unique and advantageous illuminated display assembly that is inexpensive to manufacture, assembly, and maintain, and that provides for ease and convenience of changing or replacing the displayed message. In one embodiment of the present invention, such an illuminated system is provided in conjunction with a poster or sign display device of the type shown and described in the above-mentioned U.S. Pat. No. 4,145,828.

The present invention provides an assembly for displaying a sign, including a sign frame and one or more lights disposed on the frame, with each light including one or more electrical conductors for conducting electric current thereto from an electric power source. The display assembly includes an electrical conductor associated with the frame and connectable to the electric power source, a light socket interconnectable with the frame and having a socket opening for receiving the light inserted therein, a connector interconnectable with the light socket and having at least one electrical conductor disposed for electrical contact with the electrical conductor on the light when the light is inserted into the light socket and the light socket is interconnected with the conductor. The electrical conductor on the connector is interconnectable in electrical contact with the electrical conductor on the frame in order to establish electrical communication between the light and the electric power source.

Preferably, the frame includes a pair of spaced-apart channel portions facing toward one another for receiving a pair of protrusions on the light socket, which can be slid or snapped into the channel portions in order to interconnect the light socket with the frame. The electrical conductor in the frame preferably includes a wire harness running therethrough, and the connector is preferably adjustable in order to accommodate wiring systems having one, two or more wires. All of the above-features and those described herein, are preferably configured and disposed in order to allow various sections of the frame to be hingedly opened and closed in order to conveniently change or replace the displayed message without interference from the electrical illumination system.

Additional objects, advantages and features of the present invention will become apparent from the following description and appended claims, taken in conjunction with the accompanying drawings.

DETAILED DESCRIPTION OF THE PREFERRED EMBODIMENTS

Figure 1:
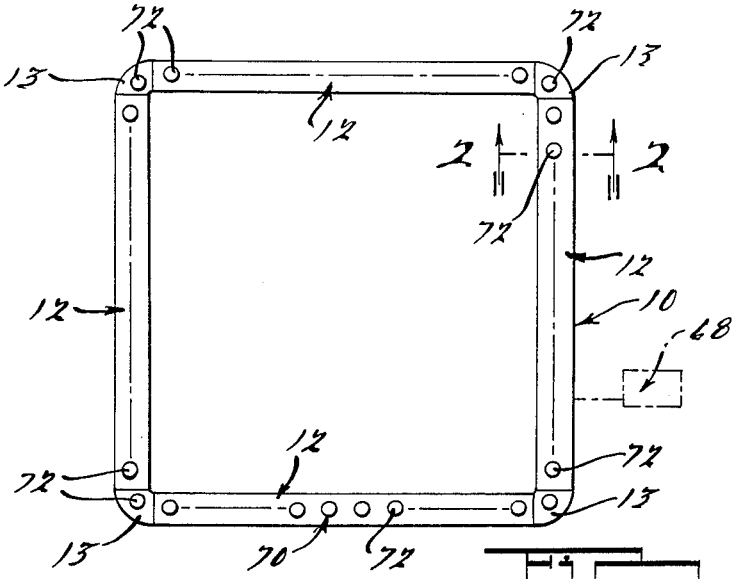
FIG. 1 is a front elevational view of an improved exemplary assembly for displaying a sign or poster in accordance with the present invention.

FIGS. 1 through 12 depict various exemplary embodiments of an assembly for displaying a sign, poster, or the like, including one or more lights on the peripheral frame portion of the assembly that are preferably adapted for illumination in sequential, flashing, continuous, or other patterns, for example. The exemplary embodiments shown in the drawings include segmented frame portins that are hingedly connected to a base portion of the assembly for pivotal movement between open and closed positions in order to facilitate the ease and convenience of changing or replacing the sign or poster. One skilled in the art will readily recognize from the following discussion and claims, taken in conjunction with the accompanying drawings, that the principles of the present invention are equally applicable to display apparatus other than the specific exemplary embodiments of the present invention depicted in the drawings.

As shown in FIG. 1, an exemplary design or poster display assembly 10 is made up of a plurality of frame sections 12, preferably interconnected by corner sections 13. Optionally, however, the present invention can be employed in display assemblies having frame sections that are cut to the desired length and mitered at suitable angles at their opposite ends for abutting and coplanar assembly with one another. As one skilled in the art will readily recognize, the display assembly 10 can be constructed with any desired polygonal shape, having an appropriate number of frame sections 12 interconnected by apex sections at their intersections, or mitered at appropriate angles for direct interconnection with one another. In addition, the frame sections 12 can be constructed either as one-piece frame sections or as multi-piece frame sections interconnected end-to-end, as desired in a particular application.

In the preferred exemplary embodiment shown in FIGS. 1 through 8, each of the frame sections 12 includes two preferably extruded metal portions 14 and 16 pivotally interconnected with one another for hinged pivotal movement of the frame portion 14 relative to the frame portion 16, as discussed below and shown in FIGS. 2 and 8. An example of a display assembly having such hinged and relatively pivotally movable frame portions is disclosed and described in the above-mentioned U.S. Pat. No. 4,145,828.

The display assembly 10 preferably also includes a rigid backing member 18, which can be composed of virtually any suitable wood or metal sheet material. The frame sections 12 are positioned around the edges of the backing member 18 to form the display assembly 10. A poster, sign or other display member 19 can thereby be positioned on the backing member 18 and held in place generally at its peripheral edges by the frame sections 12.

The back or rearward frame portion 16 can be fastened or interconnected in virtually any conventional manner to a supporting member, such as a post, wall, or the like. By virtue of the configuration of the frame sections 12, and in particular the frame portion 16, the backing member 18 is not necessary in many applications. In such applications, the display assembly 10 can be mounted on a flat surface, forming a substitute for the backing member 18, or the sign 19 can be composed of a relatively rigid material that does not require a backing member for stiffness and support.

It should be noted that the frame portions 14 and 16 are preferably composed of a material that can be efficiently and economically extruded or molded and that presents an attractive external appearance in order to form a pleasing and durable structure. Examples of suitable materials include plastics or other synthetics, aluminum, or magnesium, for example.

The outer or front portion 14 of each frame section 12 is preferably interconnected with the back portion 16 by way of a hinge assembly 28. An exemplary hinge assemby 28 is shown in the drawings and includes a cylindrical hinge or pivot pintle portion 30 protruding laterally outwardly by way of a bridge element 32 from a back wall 34 of the frame portion 16. The hinge assembly 28 also includes a corresponding, generally cup-shaped portion 36 formed on a back panel 38 of the frame portion 14. The cup-shaped portion 36 preferably extends through an arc of more than 180 degrees about the pintle portion 30, and the two frame sections 14 and 16 can therefore be either slidably interconnected longitudinally or snapped laterally together during assembly of the display apparatus.

Figure 2:
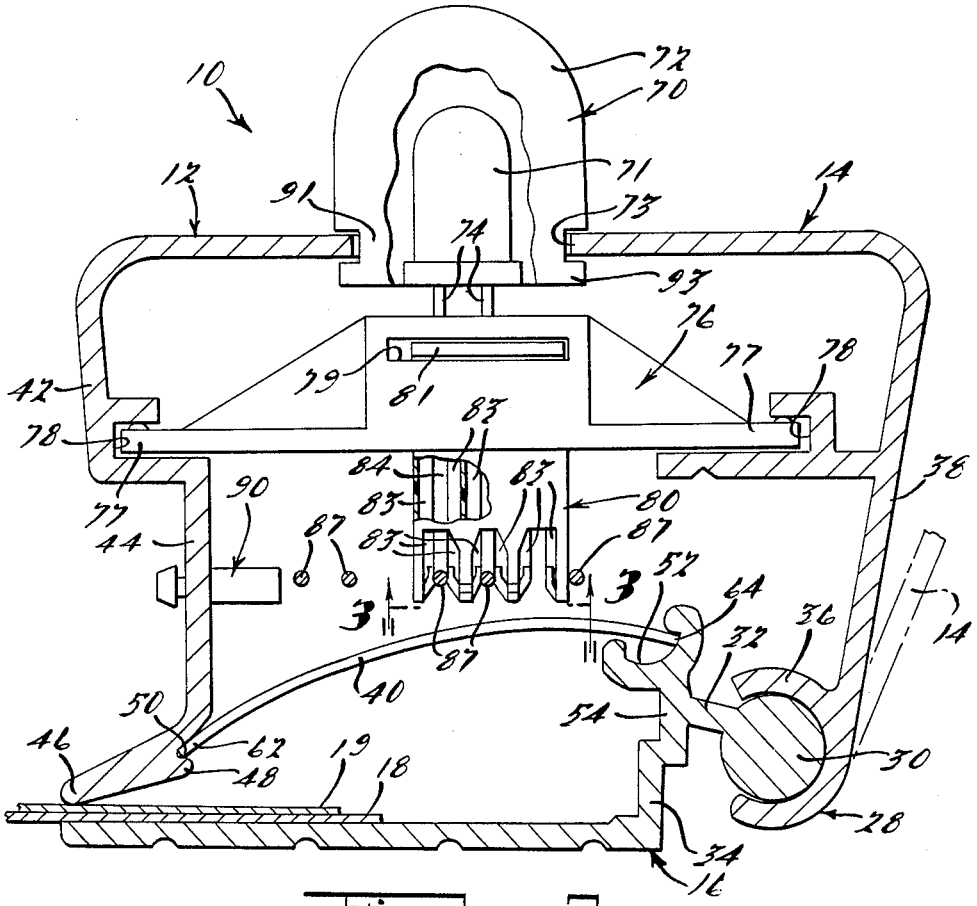
FIG. 2 is a cross-sectional view taken generally along line 2—2 of FIG. 1 and illustrating one preferred exemplary embodiment of the display assembly and elimination system.
Figure 4:
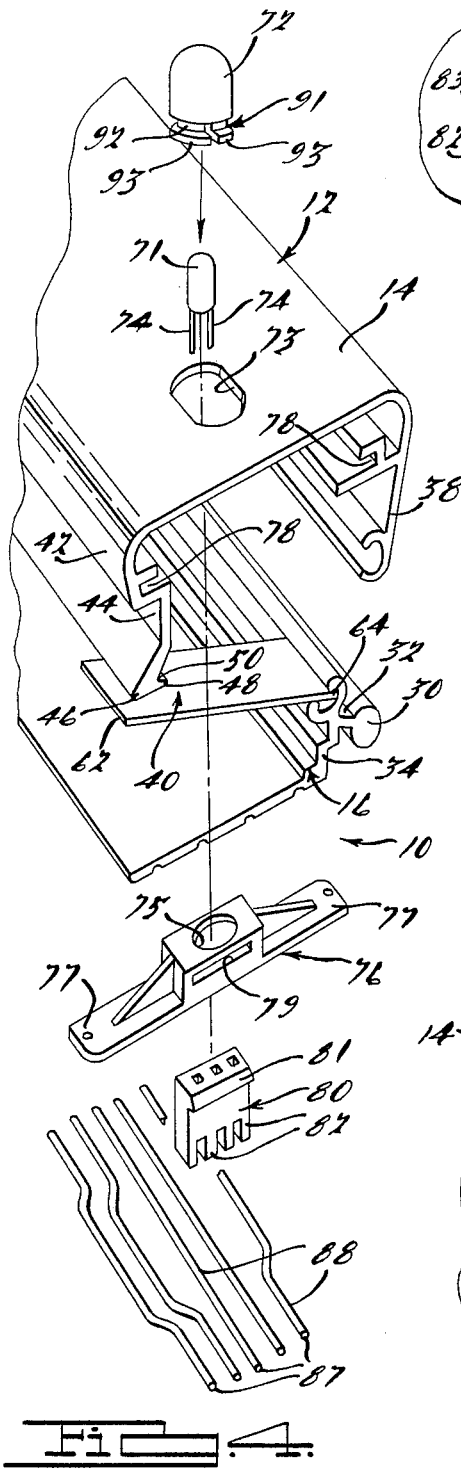
FIG. 4 is a partial exploded perspective view of the display assembly of FIGS. 1 through 3.
Figure 3:
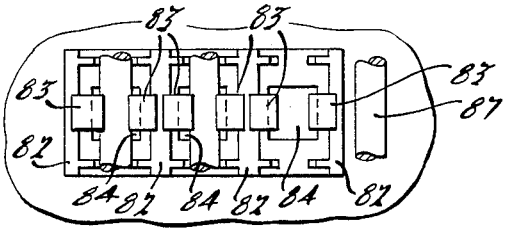
FIG. 3 is a cross-sectional view taken generally along line 3—3 of FIG. 2.
Figure 5:
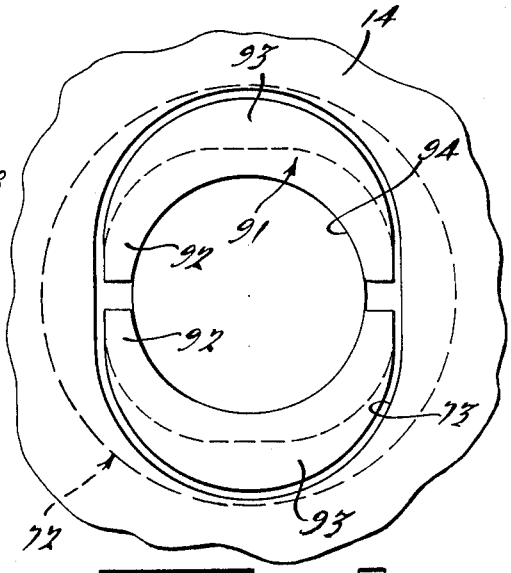
FIG. 5 is an enlarged detailed bottom view, illustrating the insertion of the lens cover for the light shown in FIGS. 1 through 4 being inserted into an opening in the frame.
Figures 8, 11:
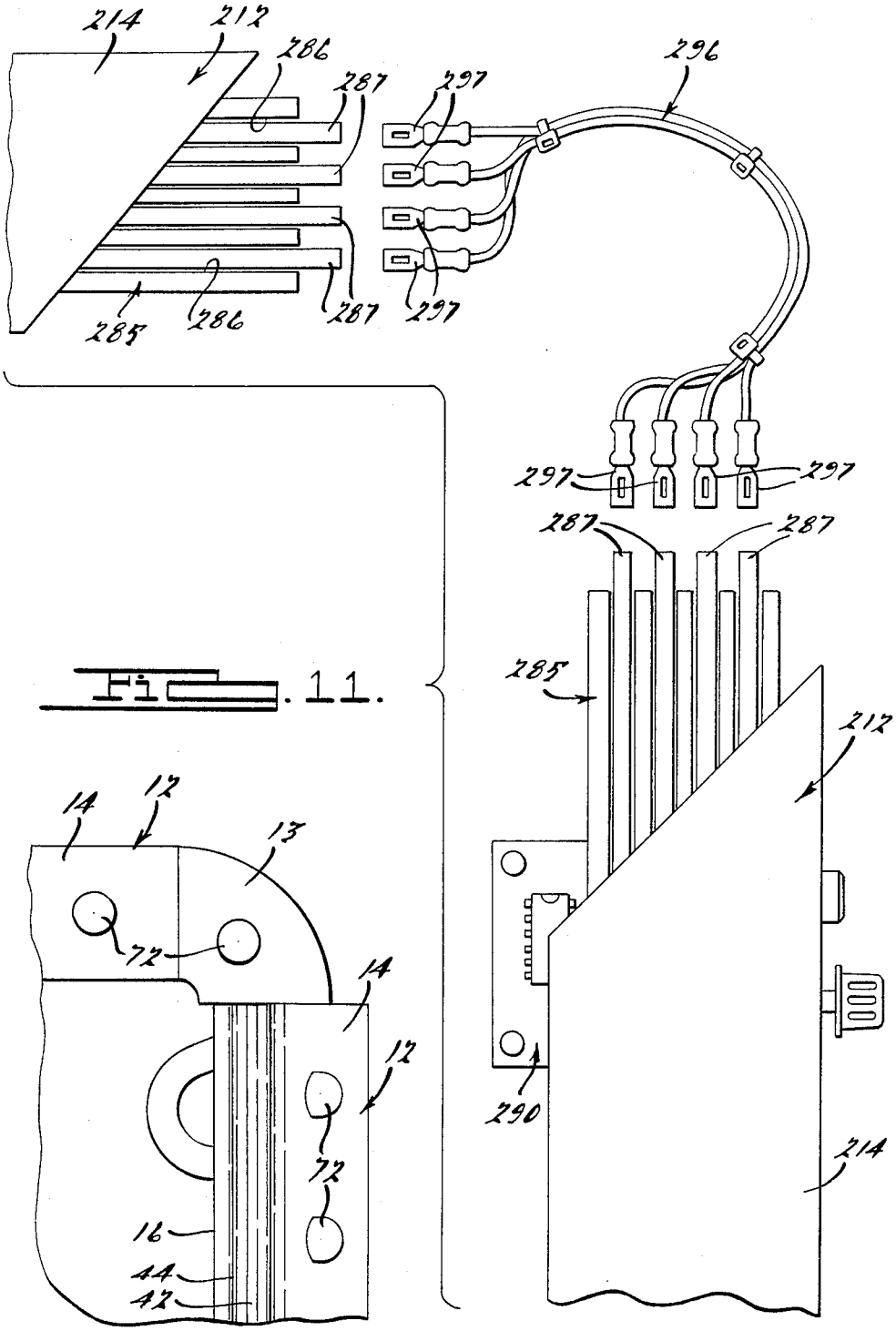
FIG. 8 is a partial elevational view of the display assembly according to the present invention, with one frame segment shown pivoted to an open position.
FIG. 11 is a partial exploded elevational view of the display assembly of FIGS. 9 and 10, illustraating the electrical connection at the corners of the frame assembly.

As shown in cross-section and in phantom lines in FIG. 2, as well as in a plan view in FIG. 8, the hinge assembly 28 provides for hinged or pivotal movement of the frame portion 14 relative to the frame portion 16. When the frame portio 14 is in the position shown in solid lines in FIG. 2, it clampingly engages the sign or display member 19 in position against the backing member 18. In order to remove or replace the sign or display member 19, the frame portion 14 can be pivoted laterally outwardly, thereby providing access to, and clearance for removal of, the sign 19. As shown in a plan view of FIG. 8, the corner sections 13 typically can be fixed in the display assembly 10 in many applications, such as where the sign or poster 19 is sufficiently flexible that laterally outward pivotal movement of the corner sections 13 is not necessary for removal or replacement. As one skilled in the art will readily recognize, the corner sections 13 can alternately be hinged for lateral outward pivotal movement in applications in which clearance is required at the corners of the display assembly 10 in order to remove or replace the sign 19. Such hinged interconnection of the corner sections 13 can be accomplished in a manner similar to that described above in connection with the frame sections 12, or by way of other hinged interconnections known to those skilled in the art.

One or more leaf springs 40 are preferably positioned in each frame section 12 between the frame portions 14 and 16. The springs 40 bias the two frame portions 14 and 16 relative to one another in order to cause clamping engagement of the frame portion 14 against the sign 19 when the frame portions 14 and 16 are in their closed position, and to biasingly maintain the frame portion 14 in its open position shown in phantom lines in FIG. 2. Such resilient biasing function of the spring or springs 40, as well as further frame structural details of the operation of the display assembly 10, are fully disclosed and described in the above-mentioned U.S. Pat. No. 4,145,828.

Preferably, the frame portion 14 includes a side panel 42, having a longitudinal groove 44 formed therein, which allows the frame portion 14 to be grasped and manipulated to its open or closed position relative to the frame portion 16. An edge portion 46 of the side panel 42 is adapted to abut the sign 19 during the clamping engagement described above. An outwardly and upwardly extending protrusion 48 is provided adjacent the edge 46 in order to form a longitudinal recess or channel 50 in the side panel 42, for receiving an edge 62 of the spring 40 when the frame portions 14 and 16 are assembled with the spring 40 installed in place. The groove or channel 50 has a sufficient depth such that the spring 40 will not be displaced therefrom when the frame portion 14 is pivoted between its open and closed position relative to the frame portion 16.

The opposite edge 64 of the spring 40 is positioned in a preferably generally arcuate-shaped channel portion 52 formed in an upstanding flange portion 54 of the frame portion 16. Preferably, the configuration and position of the channel 52 provides for unrestricted movement of the edge 64 of the spring 40 over an approximately 90 degree arc as the frame portion 14 is opened and closed, while preventing the edge 64 from being displaced from within the channel 52. The configuration of the channel 52 further allows the use of a generally flat leaf spring 40, which can be easily and inexpensively manufactured, and which can be quickly and conveniently installed within the frame sections 12.

Figure 7:
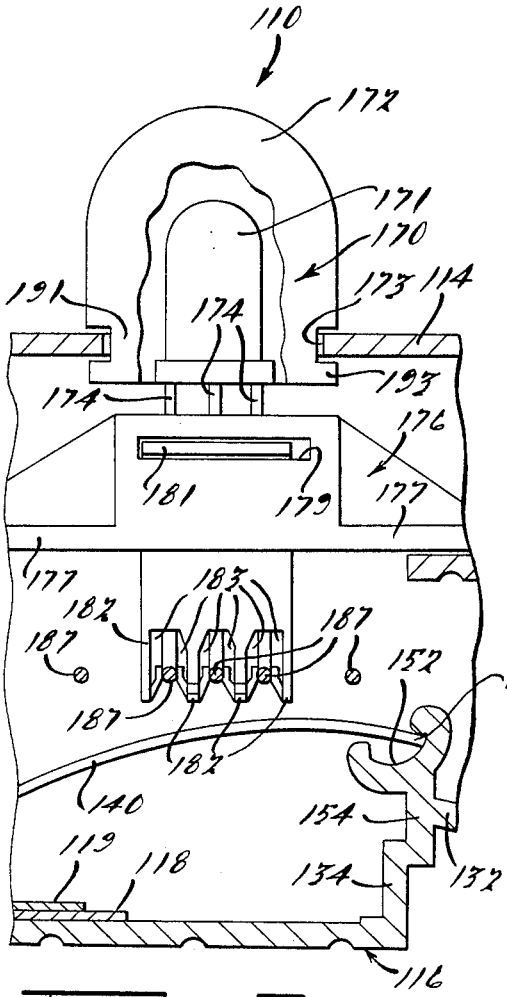
FIG. 7 is a cross-sectional view similar to that of FIG. 2, but illustrating a variation of the present invention adapted for a three-wire electrical system.

When the various elements of the frame sections 12 are assembled in place as shown in the drawings, the cantilevered spring 40 exerts sufficient frictional force against the frame portion 14 to resist longitudinal shifting of the frame portions 14 and 16 relative to one another at the hinge assembly 28. The spring 40 also exerts a generally inwardly and outwardly directly over-center force to biasingly retain the frame portions 14 and 16 in their closed or open positions, as discussed above. Although the spring 40 is shown in FIGS. 2 and 7 as having a generally arcuate configuration when installed in the frame sections 12 and resiliently deflected between the channels 50 and 52, the spring 40 is preferably generally flat and planar in its free state, as shown in the exploded view depicted in FIG. 4. Such a construction allows the spring 40 to be easily and inexpensively fabricated from sheet-like spring material, as mentioned above.

In accordance with the present invetion the display assembly 10 is equipped with a preferably multiple-light illumination system 70 disposed on the frame sections 12 and the corner sections 13. The lighting system 70 includes one or more lights 71 disposed along the frame sections 12 and 13 and preferably housed within a corresponding number of lenses 72. The light 71 and lenses 72 are received within openings 73 formed in the frame portions 14 of the frame sections 12, and in corresponding openings in the corner sections 13. Each light 71 includes an electrical conductor 74 thereon for conducting electric current thereto from a power source 68 shown diagrammatically in phantom lines in FIG. 1. In this regard, it should be noted that the power source can be any suitable power supply system of either a vehicle in mobile applications, or a stationary electrical power source in stationary applications of the present invention.

The electrical conductor 74 of each light 71 extends through the frame portions 14 into an opening 75 formed in a socket member 76 disposed within the frame section 12. Preferably, the socket member or members 76 include laterally-extending protrusions 77 thereon, which are received within channels 78 formed in the frame portions 14 in order to interconnect the socket members 76 with the frame sections 12. Such interconnection is easily accomplished in the embodiments shown in FIGS. 1 through 8 by inserting the socket member 76 within the frame portions 14 with the protrusions 77 oriented generally longitudinally, and then rotating the socket member 76 into a position wherein the protrusions 77 are frictionally and slidably received and retained within the channels 78.

The socket member or members 76 also preferably include openings 79 extending in a longitudinal direction relative to the frame sections 12 for interconnection with a corresponding number of connector members 80 disposed within the frame portions 14. The preferred connector member or members 80 each include a tab 81 adapted to be interlockingly received and snapped in place within the openings 79 and the socket member 76 in order to conveniently interconnect the connectors 80 with the sockets 76. The connector member or members 80 also preferably include a number of laterally spaced-apart legs 82 depending therefrom, with electrical conductors 83 disposed thereon and extending upwardly within openings 84 formed between the spaced-apart legs 82. The conductors 83 on the connector members 80 extend upwardly as viewed in FIG. 2 in order to allow for electrical contact between conductors 83 on the connectors 80 and the conductors 74 on the lights 71 when the lights 71 are installed on the display assembly 10 with their conductors 74 received within the openings 75 in the socket member 76 and extending into the openings 84 on the connector members 80.

The conductors 83 on the connector members 80 are laterally spaced-apart between the corresponding legs 72 for purposes of receiving and engaging one or more conductors 87 forming a wire harness running longitudinally through the frame sections 12 and the corner sections 13. As the conductor or conductors 87 are forcibly inserted between the conductors 83 on the connectors 80, the conductors 83 are adapted to pierce and displace any electrical insulation 88 on the conductors 87 of the wire harness. By such displacement of the electrical insulation, an electrical contact between the conductors 83 and the conductors 87 is established. This is coupled with the above-described electrical contact between the conductors 83 and the conductors 74 of the light 71, in order to establish an electrical interconnection between the power source 68 and the lights 71 in order to convey electrical current to the light 71 for purposes of illumination. In this regard, the display assembly 10 preferably also includes a circuit control apparatus 90 for controlling the supply of electric current from the power source 80 to the lights 71.

In applications wherein a plurality of lights 71 are disposed longitudinally along the frame sections 12 and on the corner sections 13, the above-mentioned circuit control apparatus 90 can consist of an electronic device, including either a microprocessor or other electronic circuitry known to those skilled in the art, for purposes of causing electric current to be supplied to the lights 71 in a continuous manner, in a sequential manner along the length of the frame portions of the display assembly 20 to cause the lights 71 to illuminate in a sequential fashion, in a blinking manner, or in virtually any other fashion, for purposes of attracting attention to, and highlighting, the display assembly 10. Electronic control apparatuses for performing any of these or other electric control functions are well-known to those skilled in the art and readily available. Therefore, the electronic and circuitry details of the circuit control apparatus 90 are not described further herein.

Preferably, the opening 79 in each socket member or members 76 is laterally enlarged to a dimension greater than the corresponding lateral dimension of the tab 81 on the corresponding connector member 80. By such a construction, the connector member 80 can be laterally moved or adjusted such that the spacing between the legs 82, and thus the conductors 83, are aligned for receiving and engaging various preselected conductors or combinations of conductors 87 in the wire harness running through the frame sectins 12. In this way, the various components of the lighting system 70 can be adapted for various preselected electrical hook-ups to suit the desired electrical operation of the lighting system 70.

In addition to the above, such lateral adjustability of the connector members 80 allows the various components of the lighting system 70 to be used in display assemblies having either single-wire or multiple wire harness arrangements and configurations. In order to accomplish such variations in the electrical connections between the connector members 80 and the conductors 87 of the wire harness, the conductors 87 that are not to be electrically interconnected with the lights 71 at a particular location are merely moved laterally aside so as to lie clear of engagement with the conductors 80 on the connector members 80 at that location. Such electrical interconnection between the conductors 87 and the connector members 80 are preferably preselected and set up for assembly in a suitable jig or other such assembly apparatus during manufacture of the display assembly 10 according to the present invention.

It should be noted that the physical and electrical connection of any light or lights 71 located on the corner sections 13 are preferably accomplished in the same manner and by way of the same components as described above in connection with the frame sections 12. However, since in many applications the corner sections 13 do not include hinged and pivotally movable upper portions, sufficient slac, in the conductors 87 of the wire harness running through the display assembly 10 is provided adjacent the corner sections 13, in order to allow for pivotal movement of the frame portions 14, as shown in FIG. 8. Such slack in the conductors 87 of the wire harness should not, however, be excessive such as to interfere with the pivotal movement of the when the frame portions 14.

Preferably, the lens or lenses 72 are interconnected with, and retained on, the corresponding frame portions 14 by way of a bifurcated base portion 91 on the lens or lenses 72, as perhaps best shown in FIGS. 2 and 4 through 6. Each base portion 91 preferably includes a pair of spaced-apart base segments 92 having laterally-extending flanges 93 thereon, with the space between the segments 92 being in communication with an internal opening 94 in the lens or lenses 72, which surrounds the lights 71 when the lenses 72 are installed in an overlying relationship with the lights.

Figure 6:
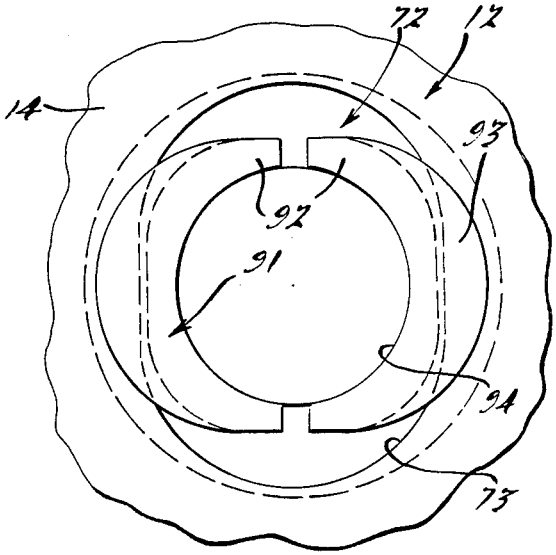
FIG. 6 is a view similar to that of FIG. 5, but illustrating the lens rotated 90 degrees in order to releasably secure the lens to the frame.

The flanges 93 on each lens 72 are preferably laterally larger at medial locations thereon that at the spacing between the segments 92. This construction results in an elongated or "oblong" configuration of the flanges 93 such that the flanges 93 can be inserted in the correspondingly elongated opening or openings 73 in the frame portions 14, as shown in a bottom view in FIG. 5. The lens or lenses 72 can then be rotated approximately 90 degrees, as shown in FIG. 6, such that the laterally enlarged portions of the flanges 93 engage the lower surface of the corresponding frame portion 14 adjacent the openings 73, thereby interlockingly but removably interconnecting the lens or lenses 72 with the corresponding frame section 12.

FIG. 7 illustrates an alternate embodiment of the present invention, in which the lighting system 170 and its various components are adapted for one or more lights 71, each having three conductors 174 thereon in a so-called three-wire system, rather than the two-wire system depicted for purposes of illustration in FIGS. 2 through 6. Other than the three-wire light 171, the various components of the display assembly 110 are substantially similar to, and interchangeable with, those of the display assembly 10. Therefore, such interchangeable elements and components are indicated by reference numerals in FIG. 7 that are similar to the corresponding reference numerals of FIGS. 1 through 6, but preceded by one-hundred prefixes.

Figure 10:
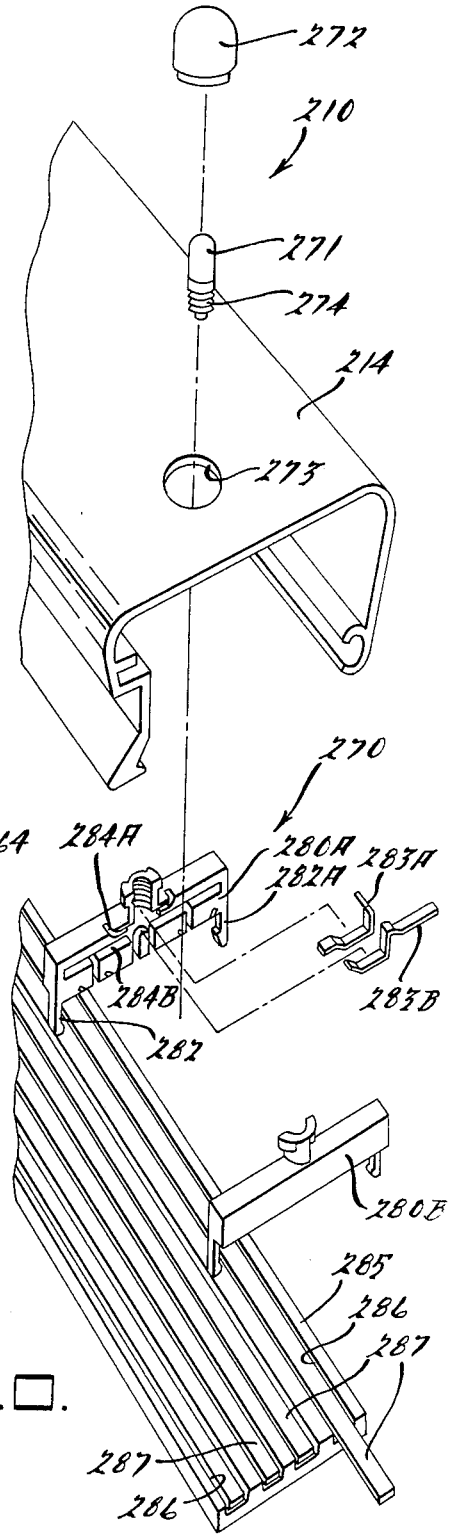
FIG. 10 is a partial exploded perspective view of the display assembly of FIG. 9.
Figure 9:
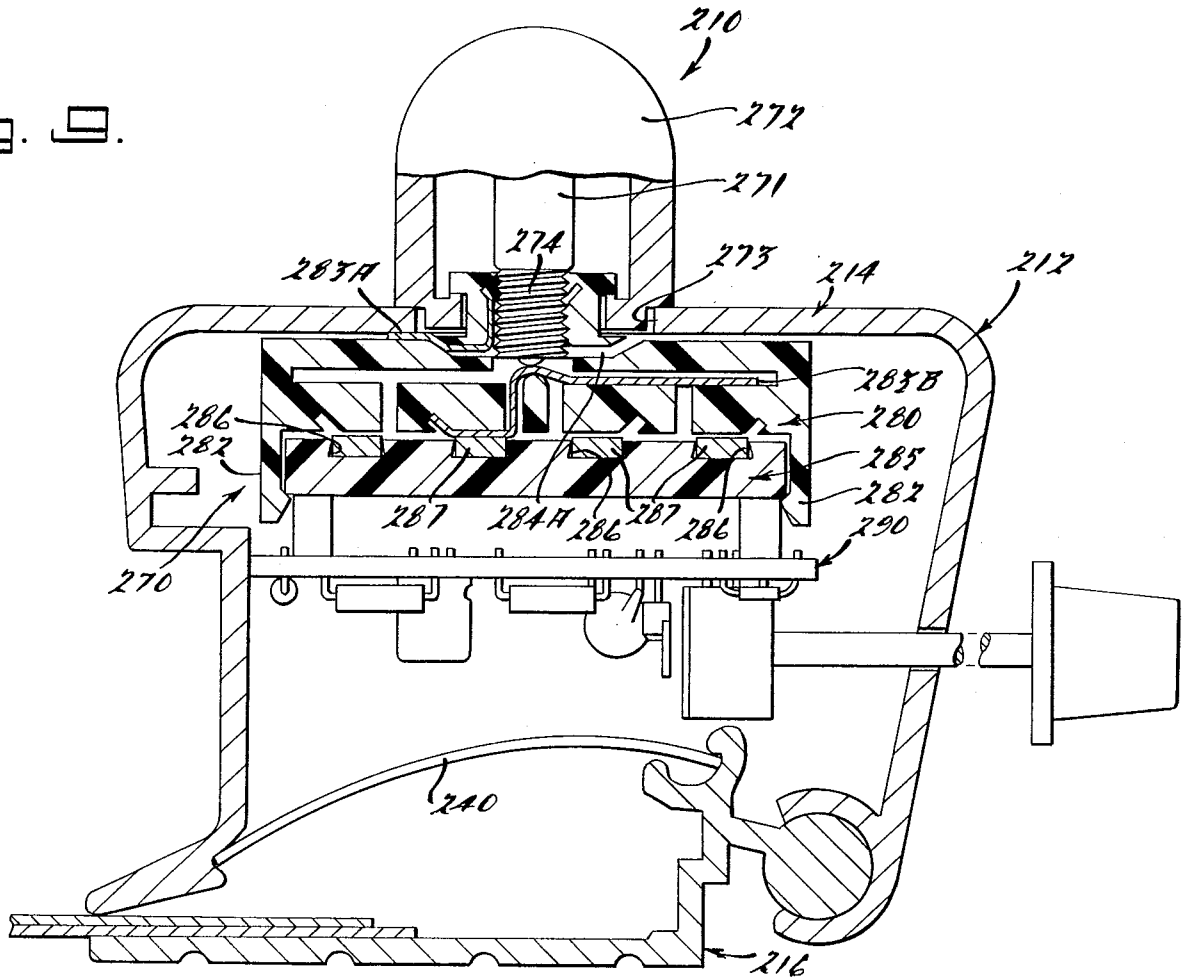
FIG. 9 is a cross-sectional view similar to that of FIGS. 2 and 7, but illustrating an alternate embodiment of the present invention.

FIGS. 9 through 11 illustrate sill another exemplary alternate embodiment of the present invention, wherein a display assembly 210 includes frame components generally similar to those described above in connection with the embodiments of FIGS. 1 through 8, but has an alternate lighting system 270. The lighting system 270 includes one or more lights 271 disposed at one or more corresponding locations on at least one of the frame portions 214. A corresponding number of lenses 272 are provided in a manner similar to that described above, with the light or lights 271 and the corresponding lens or lenses 272 received in one or more corresponding openings 273 in the frame portions 214. In the embodiment depicted in FIGS. 9 through 11, however, each light 271 includes a threaded conductor 274 of a generally conventional type and configuration, which is threadably received in an opening 284 in a combined socket and connector member 280.

The combined socket and connector member 280 preferably includes a pair of body members 280A and 280B adapted for mating interconnection and engagement with one another. The socket and connector member 280 also includes openings 284A and 284B, for receiving and retaining conductors 283A and 283, respectively.

A non-conducting strip member 285 preferably includes a number of longitudinally-extending grooves 286 formed therein for housing and retaining a corresponding number of conductors 287 therein. Such assembly of the strip member 285 and the conductors 287 generally corresponds in function to the wire-harnes and conductors 287 and 187 described above in connection with the embodiments of FIGS. 1 through 8.

When the socket and connector member 280 is assembled, with the conductors 283A and 283B housed within their respective openings 284A and 284B, the legs 282 of the socket and connector member 280 can be resiliently snapped onto the lateral edges of the strip member 285 in order to interconnect the socket and connector member 280 therewith. In such assembled relationship, the conductor 283B engages one or more preselected conductors 287 on the strip member 285, and the corresponding lights 271 can be threadably interconnected with the socket and connector member 280 to establish electrical contact between the conductors 287 and the light or lights 271. In this regard, it should be noted that one or more conductors 283B can be inserted in a corresponding number of portions of the opening 284B in order to electrically contact one or more of the conductors 287 on the strip member 285, thereby allowing the lighting system 270 to be adapted for use in one-wire or multiple-wire electrical systems. Furthermore, the lighting system 270 also preferably includes a circuit control apparatus 290, which is similar in function to the control apparatus 90 and 190 for controlling the illumination of the lights 271 as described above.

Although the display assembly 210 shown in FIGS. 9 through 11 is similar in many respects to the display assemblies 10 and 110 described above, certain other differences in the components of the lighting system 270 exist, as described above. Accordingly, functionally similar or corresponding elements of the display assembly 210 are indicated by reference numerals similar to those used in connection with the display assemblies 10 and 110 described above, except for the addition of two-hundred prefixes.

Furthermore, although the frame sections 212 are shown to be of a mitered configuration as shown in FIG. 11, corner sections similar to the corner sections 13 and 113 described above and shown in FIGS. 1 through 8 can alternately be used. In such an application, more than one of the corner harnesses 296, having connectors 297 adapted for interconnection with the conductors 287, are required in order to provide electrical interconnection at each end of such a corner section. In the embodiment depicted in FIGS. 9 through 11, however, only one of such corner harnesses 296 is required for providing electrical interconnection directly between the adjacent frame sections 212.

Figure 12:
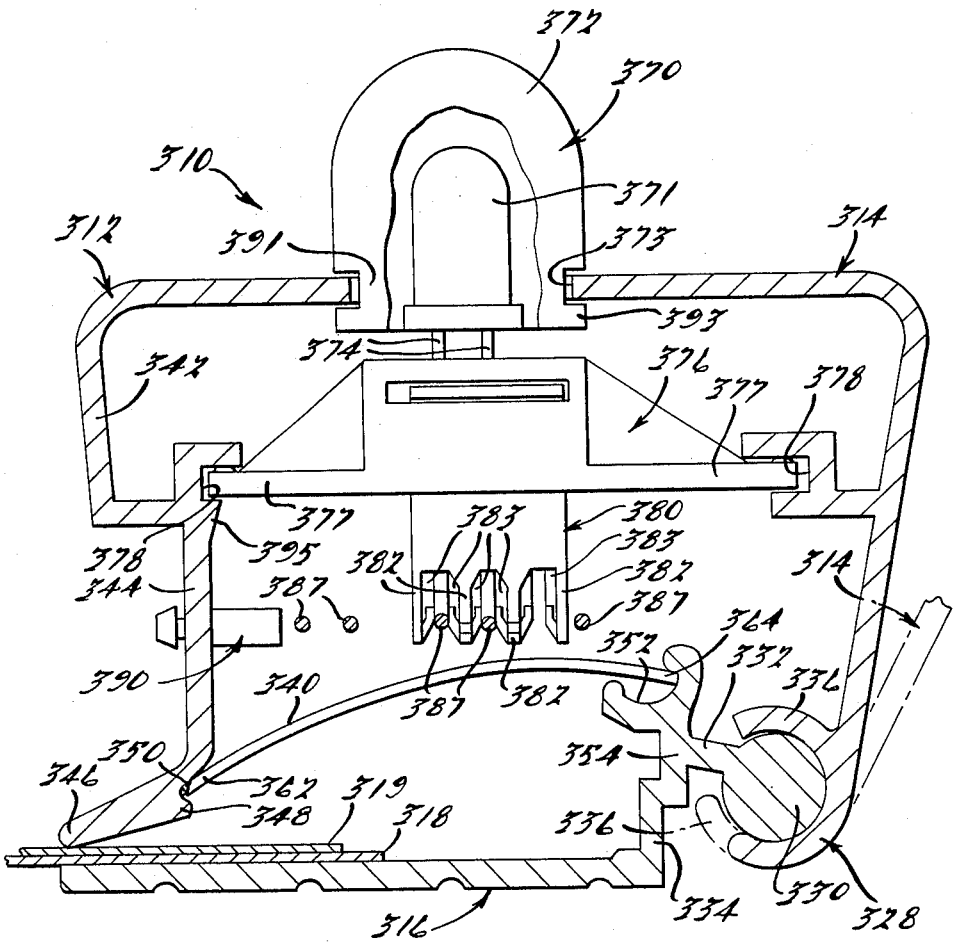
FIG. 12 is a cross-sectional view similar to that of FIG. 2, but illustrating another variation on the present invention.

FIG. 12 illustrates another embodiment, which is similar in many respects to the embodiments of FIGS. 1 through 8, and which therefore includes reference numerals similar to those of FIGS. 1 through 8, except that similar or generally corresponding elements are indicated by reference numerals having three-hundred prefixes.

In FIG. 12, the display assembly 310 includes a pair of channels 378 that are adapted for interlocking receiving a pair of protrusions 377 on a socket member 376 in order to interconnect the socket member 376 with the frame portion 314. The socket member 376 is positioned within the frame portion 314 with one of itrs protrusions 377 inserted into the right-hand channel 378 (as viewed in FIG. 12). The other protrusion 377 is then urged generally upwardly past a sloped protrusion 395 on the frame portion 314 where it snaps into place in the channel 378 that is adjacent the sloped protrusion 395. By this construction, the protrusions 377 of the socket member 376 can be insertibly received within the channels 378 without the need for the clearance required for the above-discussed lateral rotation of the socket member 76 or 176 to slidably position the protrusions 77 or 177 within the channels 78 or 178, as discussed above in connection with the embodiments of FIGS. 1 through 8.

The foregoing discussion discloses and describes exemplary embodiments of the present invention. One skilled in the art will readily recognize from such discussion, and from the accompanying drawings and claims, that various changes, modifications, and variations may be made therein without departing from the spirit and scope of the invention as defined in the following claims.

We claim:

1. An assembly for displaying a signal, said assembly including a sign frame and at least one light on said frame, the light including at least one electrical conductor thereon for conducting electric current thereto from an electrical power source, said assembly further comprising:

at least one electrical conductor associated with the frame and connectable to the electrical power source;

a light socket interconnected with said frame and having a socket opening therein for receiving the light inserted therein, said light socket including a connector opening therein;

a connector interconnectable with said light socket, said connector having at least one electrical conductor thereon disposed for electrical contact with said electrical conductor on the light when the light is inserted into said light socket and said light socket is interconnected with said connector, said connector including connecting means for connecting said frame electrical conductor in electrical contact with said electrical conductor on said connector in order to establish electrical communication between the light and the electrical power source, said connector including a tab portion insertable into said connector opening in said light socket in an interlocking relationship therewith.

2. An assembly for displaying a sign, said assembly including a sign frame and at least one light on said frame, the light including at least one electrical conductor thereon for conducting electric current thereto from an electrical power source, said assembly further comprising:

at least one electrical conductor associated with the frame and connectable to the electrical power source;

a light socket interconnectable with said frame and having a socket opening therein for receiving the light inserted therein, the frame including a pair of spaced-apart channel portions oriented in opposite directions facing one another, said light socket including a pair of protrusions insertable into said channel portions of said frame in order to interconnect said light socket with the frame;

a connector interconnected with said light socket, said connector having at least one electrical conductor thereon disposed for electrical contact with said electrical conductor on the light when the light is inserted into said light socket and said light socket is interconnected with said connector, said connector including connecting means for connecting said frame electrical conductor in electrical contact with said electrical conductor on said connector in order to establish electrical communication between the light and the electrical power source.

3. An assembly according to claim 2, wherein at least a portion of the frame is elongated in a longitudinal direction, said channel portions extending longitudinally along said frame and being laterally spaced from one another, said socket being receivable between said channel portions when said protrusions are in a generally longitudinally-extending orientation, and said protrusions being received within said channel portions when said light socket is rotated to position said protrusions in a generally laterally-extending orientation.

4. An assembly according to claim 2, wherein said connecting means includes at least a pair of spaced-apart legs on said connector, said electrical conductor on said connector being disposed between said connector legs, and said frame electrical conductor being receivable between said connector legs in electrical contact with said electrical conductor on said connector.

5. An assembly according to claim 4, wherein said connector further includes at least one conductor opening therein on an opposite side thereof from said legs, said electrical conductor on said connector extending through at least a portion of said conductor opening and into the space between said legs, the electrical conductor on the light being receivable within said conductor opening in electrical contact with said electrical conductor on said connector when the light is inserted into said light socket and said light socket is interconnected with said connector.

6. An assembly according to claim 4, wherein said frame electrical conductor includes electrical insulation thereon, said electrical conductor on said connector displacing a portion of said electrical insulation in order to contact said frame electrical conductor when said frame electrical conductor is forcibly inserted into the spaced between said connector legs.

7. An assembly for displaying a sign, said assembly including a sign frame and at least one light on said frame, the light including at least one electrical conductor thereon for conducting electric current thereto from an electrical power source, said assembly further comprising:

at least one frame electrical conductor associated with the frame and connectable to the electrical power source;

a light socket interconnectable with said frame and having a socket opening therein for receiving the light inserted therein;

a connector interconnectable with said light socket, said connector having at least one electrical conductor thereon disposed for electrical contact with said electrical conductor on the light when the light is inserted into said light socket and said light socket is interconnected with said connector, said connector including connecting means for connecting said frame electrical conductor in electrical contact with said electrical conductor on said connector in order to establish electrical communication between the light and the electrical power source; and said frame electrical conductor being attached to a non-conducting strip member, said connector having attaching means thereon for attaching said strip member thereto, said frame electrical conductor and said electrical conductor on said connector being disposed for electrical contact with one another when said strip member is attached to said conductor, said attaching means including a pair of tabs spaced apart from one another on said connector for receiving said strip member inserted therebetween, said tabs having protrusions thereon for interlockingly engaging said strip member when said strip member is inserted therebetween.

8. An assembly according to claim 7, wherein said connector further includes a base portion interconnecting said tabs, said base portion having a base opening therein, said electrical connector on said connector extending through said base opening in order to be contactable by the electrical conductor on the light on one side of said base portion and contactable by the frame electrical conductor on an opposite side of said base portion.

9. An assembly for displaying a sign, said assembly including an elongated sign frame and at least one light on said frame, the light including at least one electrical conductor thereon for conducting electric current thereto from an electrical power source, said assembly further comprising:

an electrical wire harness associated with said frame and extending longitudinally therealong, said wire harness including at least one longitudinally-extending frame electrical conductor electrically connectable to the power source;

an elongated frame member having a pair of laterally spaced-apart channel portions thereon oriented in opposite directions facing one another and interconnected by a base portion having a frame opening extending therethrough for receiving the light inserted therein;

a light socket having a pair of protrusions thereon extending in generally opposite lateral directions therefrom, said protrusions being insertably receivable with said spaced-apart channel portions in order to interconnect said light socket with said frame member, said light socket further having a socket opening extending therethrough and positioned for general alignment with said frame opening for receiving the electrical conductor on the light when said light socket is interconnected with said frame member and the light is inserted into said frame opening; a connector having a portion thereof insertably receivable in a portion of said socket opening in order to interconnect said connector with said light socket, said connector including at least a pair of spaced-apart legs and an electrical conductor disposed between said spaced-apart legs, said electrical conductor of said wire harness being insertably receivable between said legs in electrical contact with said electrical conductor on said connector, said connector further having a conductor opening extending therethrough in communication with the space between said legs and positioned to generally align with said socket opening when said connector is interconnected with said light socket, said electrical conductor on said connector extending into at least a portion of said conductor opening, the electrical conductor on the light being insertably receivable in said frame opening, said socket opening and said conductor opening to electrically contact said electrical conductor on said connector when said connector is interconnected with said light socket and said light socket is interconnected with said frame member, in order to establish electrical contact between the electrical conductor on the light and said electrical conductor of said wire harness.

10. An assembly according to claim 9, wherein said light socket includes a second opening therein in communication with said socket opening, said portion of said connector having a protrusion thereon interlockingly receivable in said second opening when said connector portion is inserted into said socket opening.

11. An assembly according to claim 9, wherein said wire harness includes a number of electrical conductors, said connector including a number of pairs of spaced-apart legs each for receiving one of said electrical conductors of said wire harness therebetween, said connector further including a corresponding number of said conductor openings each in communication with the space between one of said pairs of legs, said connector further including a corresponding number of electrical conductors each extending through one of said conductor openings and into the space between one of said pairs of legs, said connector being selectively movable in a generally lateral direction in order to laterally align preselected pairs of said legs with preselected electrical conductors of said wire harness.

12. An assembly according to claim 10, wherein the frame includes an elongated frame base portion, said frame member being hingedly interconnected with said frame base portion and pivotally movable relative thereto about a generally longitudinally-extending axis.

13. An assembly according to claim 10, further including a lens member and means for removably and interlockingly interconnecting said lens member with said frame member in a generally overlying relationship with the light when the light is inserted into the frame opening.

14. An assembly according to claim 10, wherein said assembly includes a number of said lights, a corresponding number of light sockets and a corresponding number of connectors interconnectable with said frame member at longitudinally spaced locations therealong, said assembly further including circuit means electrically connected with said wire harness for sequentially electrically interconnecting said lights with said power source in order to sequentially illuminate said lights along said frame member.

15. A display holder having a plurality of frame sections forming a polygonal frame structure to receibve and hold a display piece, each of said sections having a pair of front and back parts adapted to be assembled in pivotal relationship with one another, said parts being provided with coacting hinge formations integral therewith and in mating pivotal engagement with one another, the improvement therein comprising first channel means formed in said back part, second channel means formed in said front part, and a spring means positioned in and extending between said first and second channel means, said spring means comprising a generally planar piece of material without any bends or folds therein, and said first channel means substantially enclosing one end of said spring means and having an arcuate-shaped center portion flanked on both sides by substantially flat wall portions, said improvement further comprising at least one light having an electrical conductor thereon, a second electrical conductor associated with said frame and disposed generally between said first and back parts of at least one of said sections, a light socket interconnectable with said front part and having a socket opening therein for receiving said light inserted therein, a connector interconnected with said light socket, said connector having at least one third electrical conductor thereon disposed for electrical contact with said electrical conductor on said light when said light is inserted into said light socket, said connector including connecting means for connecting said second electrical conductor in electrical contact with said third electrical conductor in order to establish electrical communication between said light and said third electrical conductor.

16. The invention according to claim 15, wherein said front part includes a pair of spaced-apart socket-receiving channel portions oriented in opposite directions facing each other, said light socket including a pair of protrusions slidably insertable into said socket-receiving channel portions in order to interconnect said light socket with said front part.

17. The invention according to claim 15, wherein said connecting means includes at least a pair of spaced-apart legs on said connector, said third electrical conductor being disposed between said connector legs, said second electrical conductor being receivable between said connector legs in electrical contact with said second electrical conductor.

18. The invention according to claim 17, wherein said second electrical conductor includes electrical insulation thereon, said third electrical conductor displacing a portion of said electrical insulation in order to contact said second electrical conductor when said second electrical conductor is forcibly inserted into the space between said connector legs.

19. The invention according to claim 15, wherein said second electrical conductor is attached to a non-conducting strip member, said connector having a pair of tabs spaced apart from one another thereon for receiving said strip member inserted therebetween, said tabs having protrusions thereon for interlockingly engaging said strip member when said strip member is inserted therebetween, said third electrical conductor being disposed for electrical contact with said second electrical conductor when said strip member is inserted between said tabs and interlockingly engaged with said protrusions.

20. A poster display frame having a plurality of sections forming a polygonal-shaped structure for receiving, holding and displaying the display indicia, each of said frame sections comprising a front part and a back part hinged together in pivotal relationship to one another and a spring for biasing the two frame parts together and holding them in closed and open positions for respectively clamping in place and removing said display indicia, said spring extending between said two frame parts and positioned in channels in each of said parts, the improvement therein comprising said channel in said back part having an arcuate-shaped center portion and two substantially flat side wall portions substantially enclosing one end of said spring thereby allowing said one end to move in said channel but not be dislodged therefrom during pivotal operation of said two frame parts, said improvement further comprising at least one light having an electrical conductor thereon, a second electrical conductor associated with said frame and disposed generally between said front and back parts of at least one of said sections, a light socket interconnectable with said front part and having a socket opening therein for receiving said light inserted therein, a connector interconnected with said light socket, said connector having at least one third electrical conductor thereon disposed for electrical contact with said electrical conductor on said light when said light is inserted into said light socket, said connector including connecting means for connecting said second electrical conductor in electrical contact with said third electrical conductor in order to establish electrical communication between said light and said third electrical conductor.

21. The invention according to claim 20, wherein said front part includes a pair of spaced-apart socket-receiving channel portions oriented in opposite directions facing each other, said light socket including a pair of protrusions slidably insertable into said socket-receiving channel portions in order to interconnect said light socket with said front part.

22. The invention according to claim 20, wherein said connecting means includes at least a pair of spaced-apart legs on said connector, said third electrical conductor being disposed between said connector legs, said second electrical conductor being receivable between said connector legs in electrical contact with said second electrical conductor.

23. The invention according to claim 22, wherein said second electrical conductor includes electrical insulation thereon, said third electrical conductor displaying a portion of said electrical insulation in order to contact said second electrical conductor when said second electrical conductor is forcibly inserted into the space between said connector legs.

24. The invention according to claim 20, wherein said second electrical conductor is attached to a non-conducting strip member, said connector having a pair of tabs spaced apart from one another thereon for receiving said strip member inserted therebetween, said tabs having protrusions thereon for interlockingly engaging said strip member when said strip member is inserted therebetween, said third electrical conductor being disposed for electrical contact with said second electrical conductor when said strip member is inserted between said tabs and interlockingly engaged with said protrusions.

* * * * *

UNITED STATES PATENT AND TRADEMARK OFFICE
CERTIFICATE OF CORRECTION

PATENT NO. : 4,782,610

DATED : November 8, 1988

INVENTOR(S) : David U. Hillstrom et al

It is certified that error appears in the above-identified patent and that said Letters Patent is hereby corrected as shown below:

| | |
|---|---|
| ON THE TITLE PAGE: | References Cited<br>Foreign Patent Documents:<br>"2005535" United Kingdom should be --2005535A-- |
| Foreign Patent Documents, | "97398A" Netherlands should be --97398--. |
| Column 1, line 32, | "assembly" should be --assemble--. |
| Column 2, line 17-18 | "elimination" should be --illumination--. |
| Column 2, line 43, | "illustraating" should be --illustrating-- |
| Column 2, line 59, | "portins" should be --portions--. |
| Column 4, line 8, | "portio" should be --portion--. |
| Column 5, line 10, | "directly" should be --directed--. |
| Column 5, line 22, | "invetion" should be --invention--. |
| Column 6, line 57, | "sectins" should be --sections--. |
| Column 7, line 4, | "80" should be --83--. |

UNITED STATES PATENT AND TRADEMARK OFFICE

CERTIFICATE OF CORRECTION

PATENT NO. : 4,782,610

DATED : November 8, 1988

INVENTOR(S) : David U. Hillstrom et al

It is certified that error appears in the above-identified patent and that said Letters Patent is hereby corrected as shown below:

| | | |
|---|---|---|
| Column 7, | line 18, | "slac" should be --slack--. |
| Column 7, | line 24, | delete "the when". |
| Column 7, | line 38, | "that" should be --than--. |
| Column 7, | line 65, | "sill" should be --still--. |
| Column 8, | line 13, | "received" should be --receivable--. |
| Column 8, | line 27, | "harnes" should be --harness--. |
| Column 9, | line 16, | "interlocking" should be --interlockingly--. |
| Column 9, | line 20, | "itrs" should be --its--. |
| Column 9, | line 43, | "signal" should be --sign--. |
| Column 11, | line 32, | "conductor" should be --connector--. |
| Column 11, | line 67, | "with" should be --within--. |

UNITED STATES PATENT AND TRADEMARK OFFICE

CERTIFICATE OF CORRECTION

PATENT NO. : 4,782,610

DATED : November 8, 1988

INVENTOR(S) : David U. Hillstrom et al

It is certified that error appears in the above-identified patent and that said Letters Patent is hereby corrected as shown below:

| | | |
|---|---|---|
| Column 13, | line 8, | "receibve" should be --receive--. |
| Column 13, | line 25, | "first" should be --front--. |
| Column 14, | line 51, | "displaying" should be --displacing--. |

Signed and Sealed this

Nineteenth Day of December, 1989

*Attest:*

JEFFREY M. SAMUELS

*Attesting Officer*

*Acting Commissioner of Patents and Trademarks*